United States Patent [19]

Pollack

[11] Patent Number: 4,727,819

[45] Date of Patent: Mar. 1, 1988

[54] SINGLE LINE MOORING SYSTEM

[75] Inventor: Jack Pollack, Reseda, Calif.

[73] Assignee: Amtel, Inc., Providence, R.I.

[21] Appl. No.: 802,860

[22] Filed: Jan. 27, 1985

Related U.S. Application Data

[63] Continuation-in-part of Ser. No. 603,434, Apr. 24, 1984, Pat. No. 4,637,335, which is a continuation-in-part of Ser. No. 438,322, Nov. 1, 1982, abandoned.

[51] Int. Cl.[4] ..... B63B 21/00

[52] U.S. Cl. ..... 114/230; 175/7; 166/354

[58] Field of Search ..... 114/230, 293, 179, 180, 114/181; 441/3-5; 166/350, 352, 354, 359, 367; 141/387, 388; 175/5, 7

[56] References Cited

U.S. PATENT DOCUMENTS

| | | | |
|---|---|---|---|
| 3,111,926 | 11/1963 | Shatto, Jr. | 114/230 |
| 3,386,407 | 6/1968 | Mount | 114/293 |
| 3,407,416 | 10/1968 | Brickhouse | 114/293 |
| 3,602,174 | 8/1971 | Gorman | 114/230 |
| 3,880,105 | 4/1975 | Bryant | 114/230 |
| 3,979,785 | 9/1976 | Flory | 114/230 |
| 4,023,517 | 5/1977 | Ryan | 114/230 |
| 4,065,822 | 1/1978 | Wilbourn | 114/230 |
| 4,107,803 | 8/1978 | Sylverst | 441/4 |
| 4,254,522 | 3/1981 | van Heigst | 441/3 |
| 4,321,720 | 3/1982 | Havre | 441/5 |
| 4,490,121 | 12/1984 | Coppens et al. | 441/5 |
| 4,648,848 | 3/1987 | Busch | 114/230 |

FOREIGN PATENT DOCUMENTS

| | | | |
|---|---|---|---|
| 1509909 | 5/1978 | United Kingdom | 114/230 |

*Primary Examiner*—Joseph F. Peters, Jr.
*Assistant Examiner*—Edwin L. Swinehart
*Attorney, Agent, or Firm*—Freilich, Hornbaker, Rosen & Fernandez

[57] ABSTRACT

A mooring system is provided, which can be rapidly installed and which is of relatively low cost. The system includes a transfer structure attached to a vessel, an anchor line extending from the transfer structure to a chain table near the sea floor, and catenary chains extending from the chain table to the sea floor. A weight hangs from the chain table to help in setting up the system and in mooring a vessel thereafter. The transfer structure includes a platform that can rotate with respect to the vessel, and a direction sensor for controlling a motor that rotates the platform opposite to rotation of the vessel, to avoid twist of the anchor line.

7 Claims, 16 Drawing Figures

FIG. 8
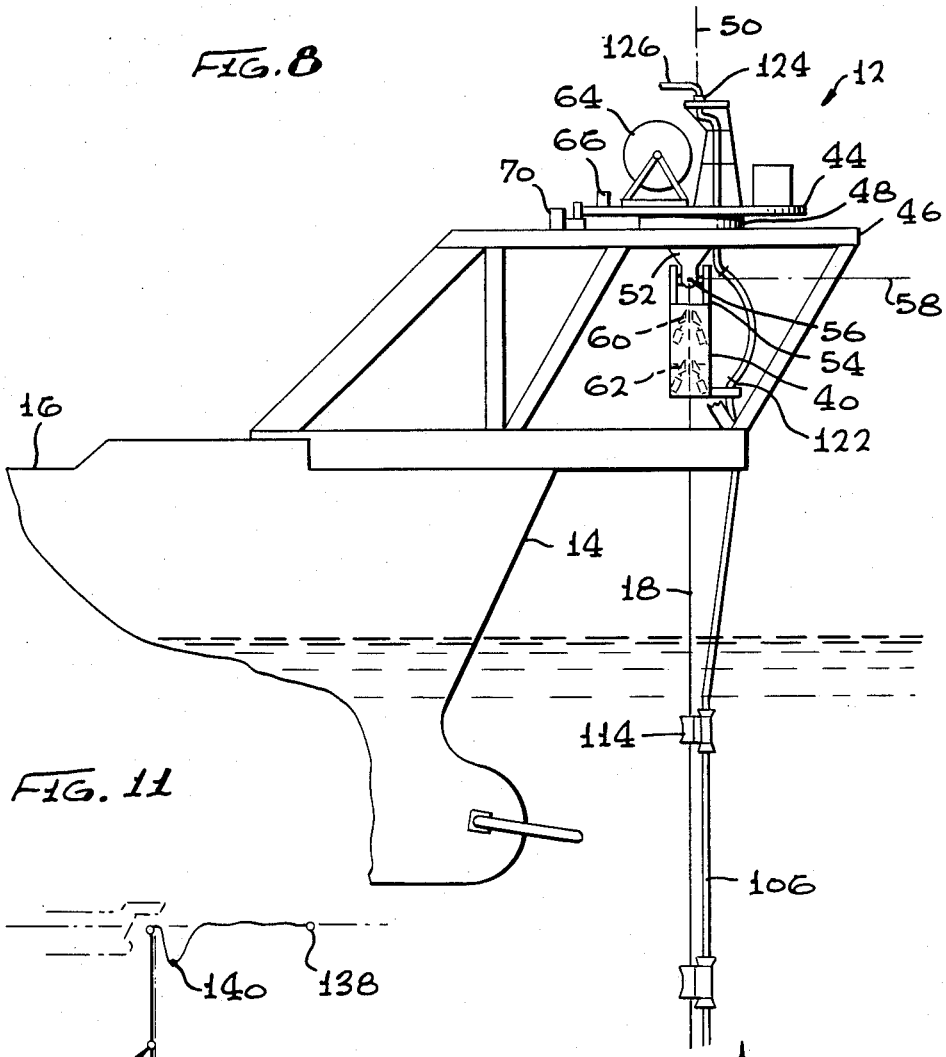
FIG. 11
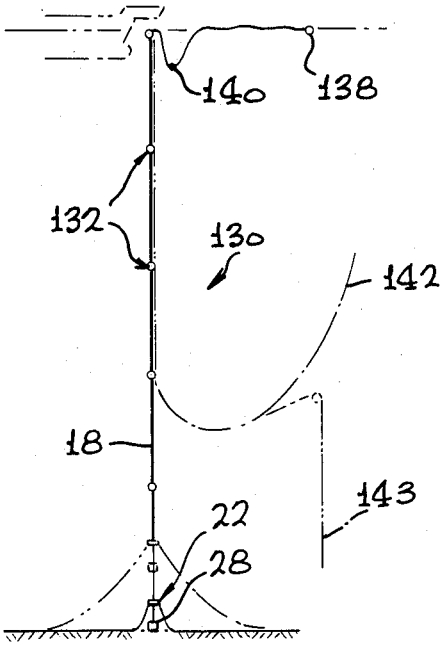
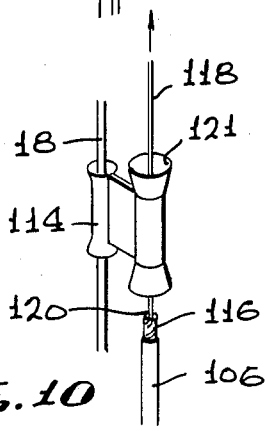
FIG. 10

SINGLE LINE MOORING SYSTEM

CROSS REFERENCE TO RELATED APPLICATION

This is continuation-in-part of Ser. No. 603,434, filed Apr. 24, 1984, now U.S. Pat. No. 4,637,335, which is a continuation-in-part of Ser. No. 438,322 filed Nov. 1, 1982 now abandoned.

TECHNICAL FIELD

This invention relates to offshore terminals for mooring a vessel, which can be useful for transferring hydrocarbons or other fluid between an underwater line and the vessel.

BACKGROUND OF THE INVENTION

A variety of offshort terminals have been proposed for mooring a vessel, especially to enable transferance of fluids between the vessel and a pipe at the sea floor or another vessel. One of the simplest and potentially lowest cost systems includes a transfer structure coupled to the vessel, a single anchor line extending down from the transfer structure, and a group of chains for holding the lower end of the anchor line and allowing its limited movement as the vessel drifts. U.S. Pat. No. 3,979,785 describes a system of this type. However, none of such simple systems have been successfully marketed. One problem has been that while the use of loose chains to hold the bottom of an anchor line minimizes the amount of chain, especially in deep waters, the reduced amount of chain results in only a low restoring force, urging the drifting vessel back towards the quiescent position of the system. Another problem is that the long vertical anchor line can be twisted as a ship drifts around the anchor line. Yet another problem is that it has been difficult to set up the system and test it. It has been even more difficult to re-establish connection to a vessel after the vessel has sailed away and then returned. A practical single anchor line mooring system would have considerable value.

SUMMARY OF THE INVENTION

In accordance with one embodiment of the invention, a mooring system is provided, of the type which includes a primarily vertical anchor line extending from a transfer structure near the sea surface to a chain table which is near the sea floor and which is anchored by catenary chains, which can be efficiently installed and operated. The system can include a weight included in or hanging from the chain table, to aid in installation and to later aid in mooring. The upper end of the anchor line can be held to a transfer structure platform which can rotate about a largely vertical axis with respect to another portion of the transfer structure. A direction sensor, such as a compass, on the platform senses its rotation and causes energization of a motor tht rotates the platform to minimize twisting of the anchor line.

The chains can initially lie on the sea floor, with pendant lines extending from the free ends of the chains up to the sea surface where they are held by floats. A chain table can be installed by attaching it to an end of the anchor line while the chain table lies primarily near the sea surface. A winch lowers the anchor line and chain table, while the chain table is guided in its decent by the pendant lines. Hose guides, or conductors, attached to the anchor line, can receive a hose extending up to the transfer structure, by pulling the end of the hose up through the conductors.

The novel features of the invention are set forth with particularity in the appended claims. The invention will be best understood from the following description when read in conjunction with the accompanying drawings.

BRIEF DESCRIPTION OF THE DRAWINGS

FIG. 8 is a right side view of a portion of the system of FIG. 1, shown with a conduit installed therein.

FIG. 10 is a partial perspective view of the system of FIG. 8, showing the manner in which the conduit is installed.

FIG. 11 is a side elevation view of a system constructed in accordance with another embodiment of the invention.

DESCRIPTION OF THE PREFERRED EMBODIMENTS

Figure 1:
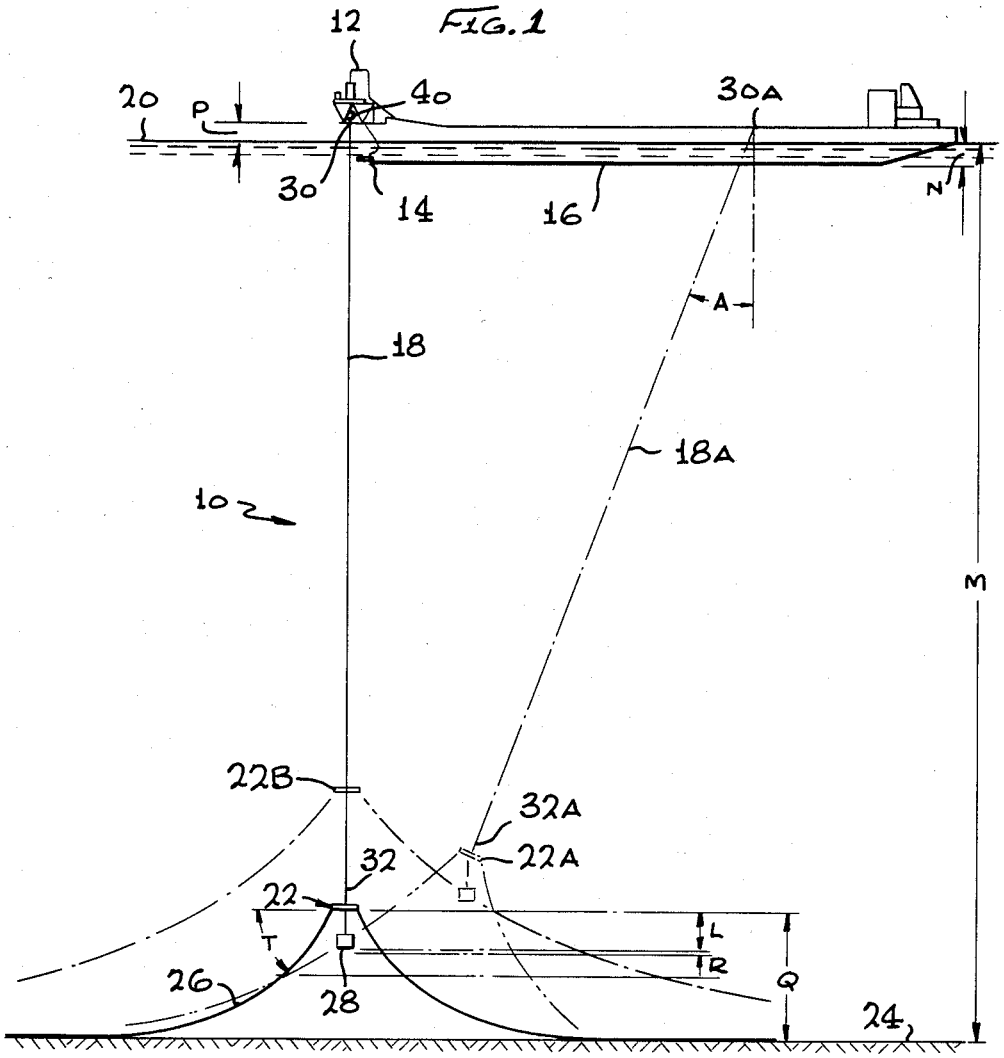
FIG. 1 is a side elevation view of an installed mooring system constructed in accordance with one embodiment of the present invention.

FIG. 1 illustrates a mooring system 10 which includes a transfer structure 12 mounted at the bow end 14 of a vessel 16. An anchor line 18 extends largely vertically between the transfer structure which lies near the sea surface 20 and a chain table 22 which lies closer to the sea floor 24 than the sea surface. The chain table lies a distance above the sea floor and is held by a group of at least three chain devices or chains 26 that extend in catenary curves to the sea floor. A counter weight 28 hangs from the chain table.

When the vessel drifts, so the upper end 30 of the anchor line at 18A has moved to the position 30A, the lower end 32 of the anchor line moves to the position 32A with the chain table at 22A. In so moving, at least one chain device 26 is raised, as by an average distance R to store potential energy which will urge the vessel back towrads its quiescent position. Since the chain table at 22 is only a moderate distance above the sea floor, only a moderate amount of chain is raised as the vessel drifts. It would be possible to use very heavy chains, but since most of the lengths of chains would lie on the sea floor, much of the chain weight would not be used. Applicant's weight 28 is raised when the vessel drifts, to restore the system towards its quiescent position wherein the anchor line 18 is vertical. The weight 28 is of low cost compared to chains of the same weight, and all of the weight 28 will always move and be raised for any direction of the vessel drift. Thus, the weight provides an efficient means for loading the lower end of the mooring line to restore a drifting vessel towards its quiescent position.

Figure 2:
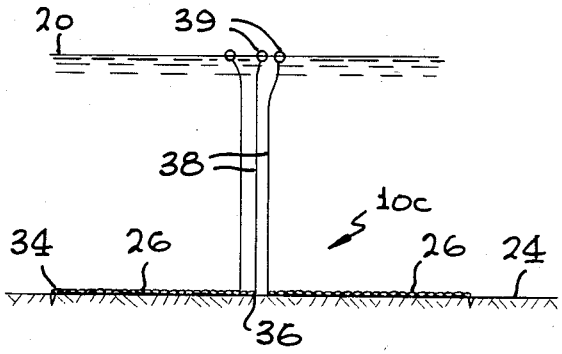
FIG. 2 is a side elevation view of the system of FIG. 1, before its connection to the transfer structure of the vessel.
Figure 3:
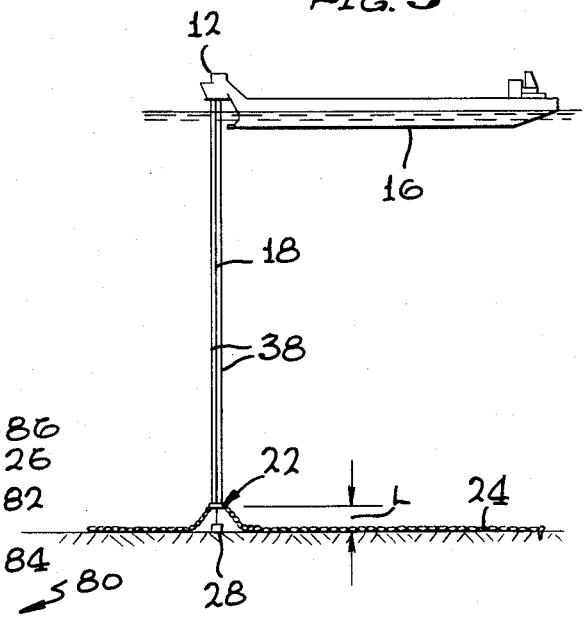
FIG. 3 is a view similar to that of FIG. 2, but showing the system during its installation.

The installation of the mooring system can be conducted easily and with minimal requirements for deep underwater work. FIG. 2 illustrates a system 10C with the chains 26 having first ends 34 held to the sea floor as by an anchor or pile and second ends 36 lying on the sea floor and attached to the lower ends of pendant lines 38. The upper ends of the pendant lines are held at the sea surface by buoys 39. As shown in FIG. 3, the vessel 16 picks up the buoys and the tops of the pendant lines and threads them through chain-receiving holes in the chain table 22 (before it is lowered). A winch 40 on the transfer structure 12 then winches down the chain table 22 until the weight 28 lies at the sea floor. The great decrease in load on the winch clearly indicates when the weight reaches the sea floor, and it is then known that the chain table lies a predetermined distance L above the sea floor. The pendant lines 38 are then pulled upward by a lightweight winch while the chain table 22 remains stationary, until the second ends 36 of the chains enter the holes of the chain table and are then locked to the chain table.

After the ends of the chains are attached to the chain table, the system must be tested by loading it to its maximum operating load. In prior systems wherein a transfer structure was anchored by chains extending from it to the sea floor, this was accomplished by bringing in a barge with a winch, and pulling on each chain individually to the maximum load. In the present system applicant uses the same winch 40 (FIG. 1) that was used to lower the chain table, to pull up the chain table until a maximum operating load has been applied. As shown in FIG. 1, the winch pulls up the anchor line 18 until a predetermined tension load is applied to the top of the anchor line. The chain table is then at the position 22B. Through geometric calculations, it can be determined what the load on each of the group of chains is. The tension on the chains is greater than the upward vertical load on the bottom of the anchor line 18, because the chains extend at least partially in a horizontal direction. After the test, the chain table is lowered to the position shown at 22.

FIG. 8 illustrates some details of the transfer structure 12 and other apparatus nearby. The transfer structure includes a largely non-rotatable platform 44 and a rotatable portion or structure 46 that is mounted on the bow end 14 of the vessel. The platform is mounted on bearing 48 that allows it to rotate about a largely vertical axis 50 with respect to the rotatable structure 46. In actuality, the platform 44 undergoes only limited rotation about the vertical axis, while the rotatable structure 46 and the vessel can rotate without limit about the vertical axis. A universal joint 52 hangs from the platform, with a hanging lower part 54 of the joint able to pivot about two horizontal axis 56, 58. The winch 40 in this embodiment of the invention, is mounted on the lower part 54 of the joint, to enable it to pivot so as to minimize bending of the anchor line 18 as it enters the winch. The winch 40 is a linear winch, which includes a stationary upper pair of jaws 60 and a lower pair of jaws 62 that move up and down. The mooring line is stored on a reel 64 where the line is curved but under substantially zero tension. The highly tensioned portion of the anchor line 18, which is the part lying under the winch, undergoes very little bending.

During and after installation of the system, the upper end of the anchor line is held by the winch 40. As discussed above, the winch initially lowers the chain table, then lifts it to test the system, and then lowers it somewhat to the height used for mooring the vessel. The winch can be operated to change the anchor line length to change the mooring characteristics. It can be later used to raise the chain table if the vessel moves away. The same vessel and transfer structure can be used at different locations of widely different sea depths, by carrying a sufficient length of anchor line.

A system of the type shown in FIG. 1 has been designed for use in a sea location of a height M of 1,200 feet (366 meters), to moor a storage vessel 16 of 65,000 tons (59,000 metric tons) dead weight at 75% of full load. The hull of the vessel then lay at a depth N of 33 feet (10 meters) below the sea surface, while the bottom of the transfer structure at the winch 40 lay a height P of 30 feet (9 meters) above the sea surface. The chain table 22 lay at a height Q of 180 feet (55 meters) above the sea floor in the quiescent condition of the system, while the bottom of the weight 28 lay a distance L of 50 feet (15 meters) below the bottom of the chain table. It can be seen that the anchor line has a height more than half the height of the sea thereat. The weight 28 had a height of about 9 feet (3 meters) and a weight of 360 thousand pounds (163 metric tons). The anchor line 18 was of 5.5 inch (14 centimeters) diameter cable which has a weight of about 65 pounds per foot (chain can be used instead), while each of the chains 26 was of 3.75 inch (9.5 centimeters) diameter, grade U-4 chain, and had a length of 2,400 feet (732 meters). The angle T of the top of each chain in the quiescent condition was about 60 degrees from the horizontal, and the chain angle, of course, approached zero degrees at locations progressively closer to the sea floor.

If the vessel 16 of FIG. 8 drifts around the vertical axis 50, the platform 44 does not have to rotate, but can remain substantially stationary to avoid twisting of the anchor line 18. However, considerable friction in the bearings 48 resist relative rotation of the platform 44. To avoid twist of the anchor line, a sensor 66 is provided on the platform to sense the direction, or orientation about the vertical axis 50, of the platform. The sensing means or sensor 66 is a compass, gyroscope, radio-wave direction sensor, or other such direction sensing device. When the sneor 66 detects substantial rotation of the platform, it controls a motor 70 to rotate the platform in a direction to counter the rotation to maintain the platform in a largely constant rotational orientation with respect to the sea floor.

Figure 5:
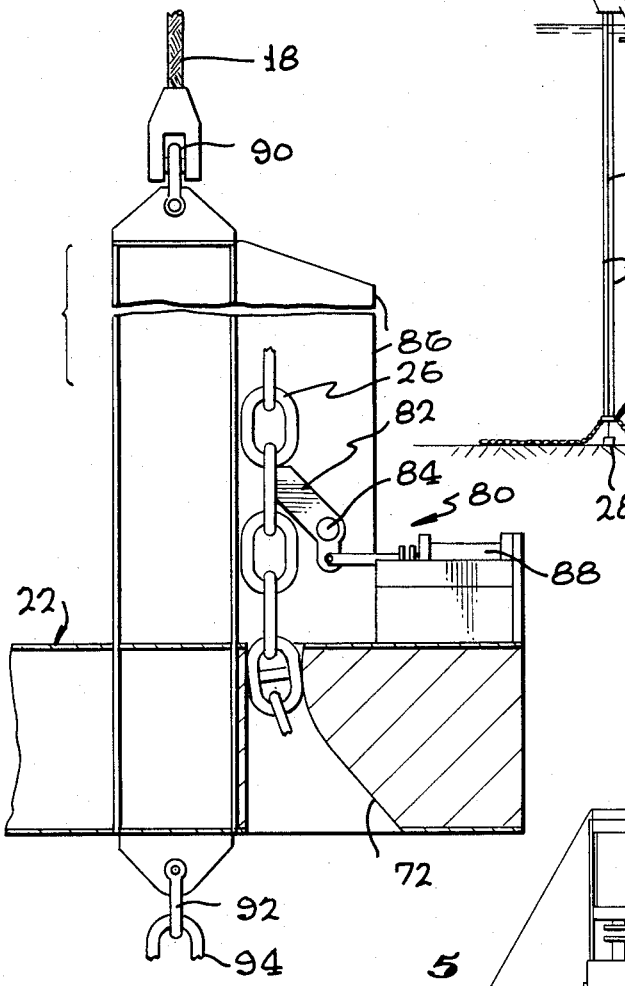
FIG. 5 is a view taken on the line 5—5 of FIG. 4.
Figure 4:
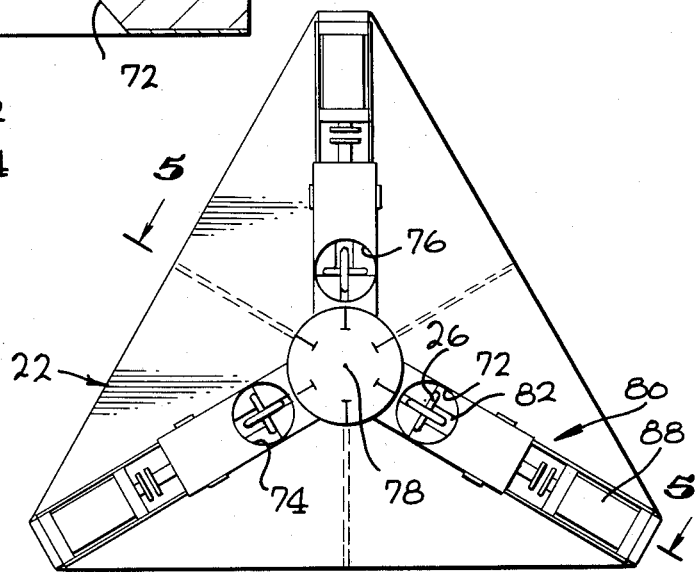
FIG. 4 is a plan view of the chain table of FIG. 1.

FIGS. 4 and 5 illustrate details of the chain table 22. The chain table has three holes 72, 74, and 76 spaced about a central vertical axis 78. A locking mechanism 80 beside each hole includes a latch 82 pivoted at 84 on the frame 86 of the chain table. A chain can be drawn up through the hole 72 past the latch 82, but when the chain starts the move down, the latch engages it and prevents such downward movement. An actuator 88 can be operated to release the latch from the chains to allow the chains to drop away from the chain table. It may be seen that the chain table has swivels 90, 92 at its upper and lower ends, the upper swivel connecting to anchor line 18, and the lower swivel connecting to a flexible chain device 94 that holds the weight that hangs from the chain table.

Figure 6:
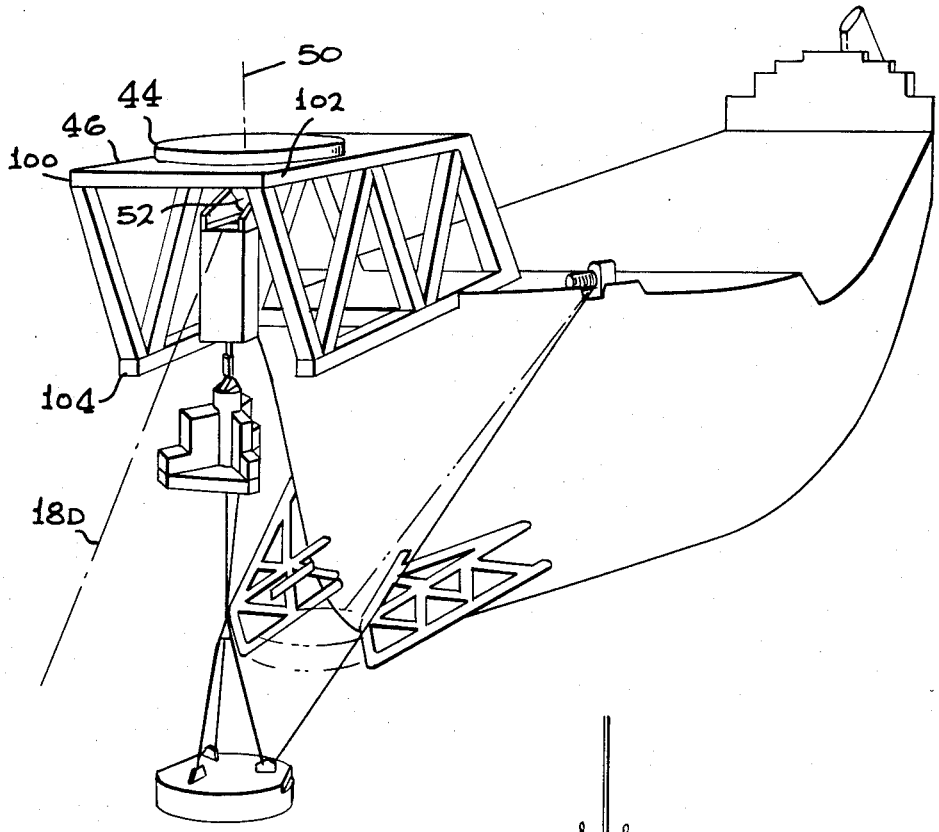
FIG. 6 is a more detailed partial perspective view of the system of FIG. 1 during installation.
Figure 7:
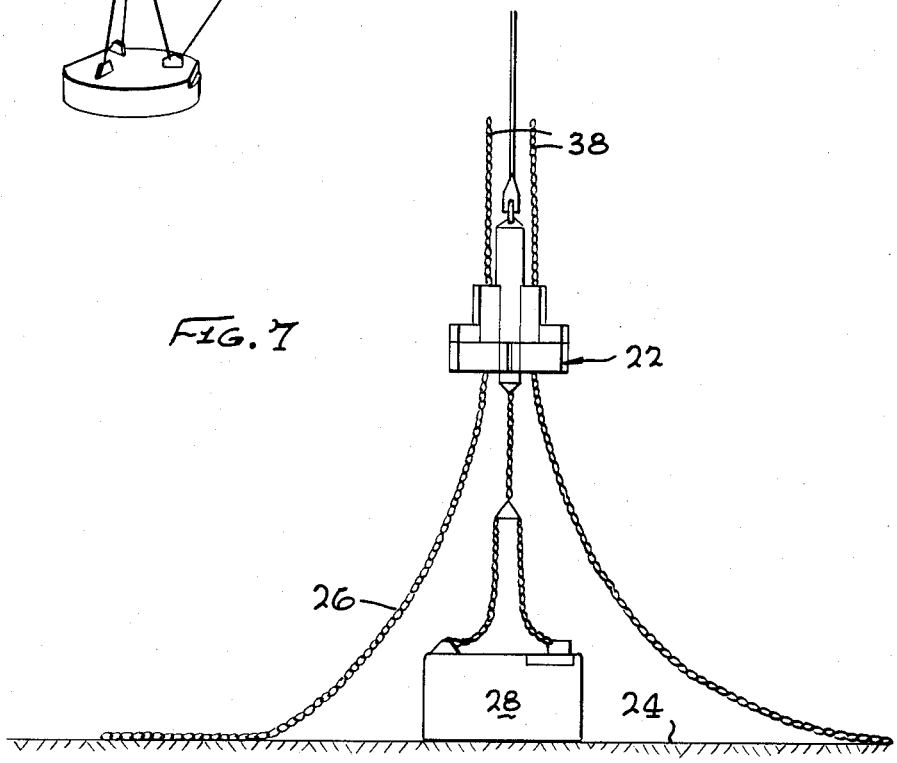
FIG. 7 is a more detailed view of a portion of the system of FIG. 3.

As can be seen in FIG. 6, the rotatable portion or structure 46 includes a pair of beams 100, 102 that extend beyond the bow of the vessel to hold bearings that support the platform 44 so the vertical axis 50 lies beyond the bow. The rotatable structure has a height of over one meter. The lower portion 104 of the portion of the transfer structure extending from the vessel is devoid of any cross beam further from the vessel than the axis 50. This allows the anchor line indicated at 18D to extend at a considerable angle from the vertical as the vessel drifts, without interference from the transfer structure.

Figure 9:
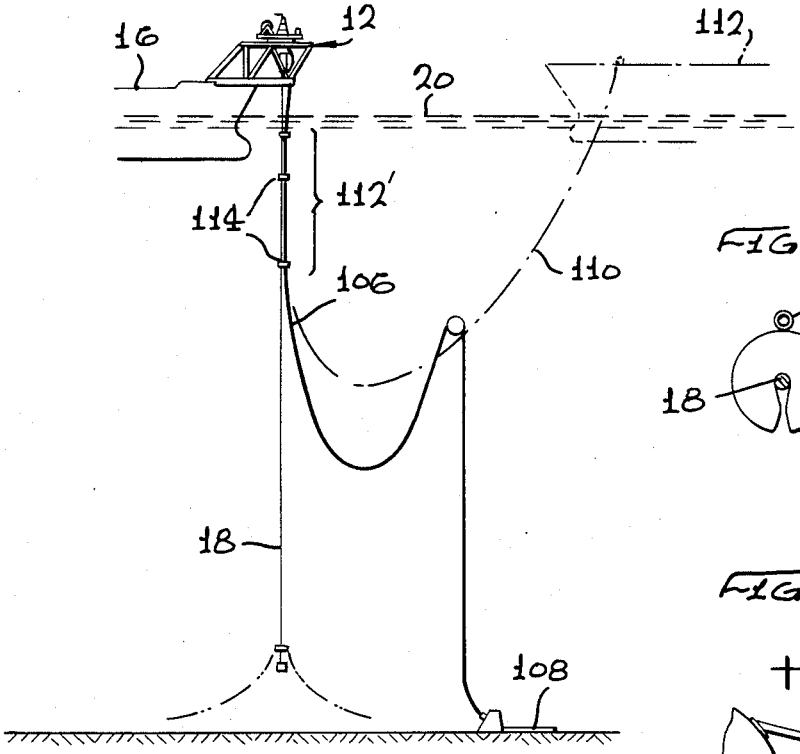
FIG. 9 is a side view of the system of FIG. 8, showing the rest of the conduit.

In many applications, a transfer structure 12 (FIG. 9) is used not only to moor a vessel, but to aid in transferring fluid such as hydrocarbons between the vessel 16 and a fluid conduit 106. The conduit 106 can extend to a fluid-holding means such as a pipe 108 at the sea floor, or as indicated at 110 to another vessel 112. Much of the conduit 106 is in the form of a hose which can bend to accommodate drifting of the vessel. However, the hose should be stabilized along a dynamic wave zone 112 which is over 100 feet deep and which may extend a few hundred feet (e.g., 300 feet) below the sea surface 20. Within this zone waves and other water movements can cause a hose to be repeatedly pushed back and forth, causing wear, and also causing damage from hitting against objects such as the vessel or the anchor line 18. To stabilize the hose, hose-receiving conductors 114 are spaced along the anchor line 18 along a considerable depth of at least 100 feet. The large tension in the anchor line 18 allows it to resist sideward movement, and its holding of the hose stabilizes the position of the hose near the sea surface.

Applicant can clamp the conductors 114 at spaced locations (e.g., every 50 feet) to the anchor line 18 as the anchor line is lowered by the winch. Alternatively, applicant can install the conductors after the anchor line is set up as by an underwater vehicle. The conduit or hose 106 can be installed by threading it upwardly through the conductors. One way, indicated in FIG. 10, is to attach an end 116 of a threading line 118 to the end 120 of the hose and to thread the line 118 through the hose-guiding holes 121 of all of the conductors (this can be accomplished before the conductors are lowered underwater). The line 118 is then pulled up to draw the hose up through the conductors. The hose is then connected at 122 (FIG. 8) to another conduit leading to a fluid swivel 124 on the platform, to connect to a pipe 126 leading to the vessel.

Figure 12:
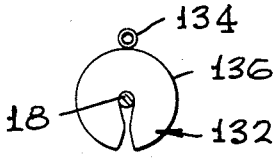
FIG. 12 is a top view of a float conductor of the system of FIG. 11.

FIGS. 11 and 12 illustrate another anchor system 130 wherein conductors 132 that are attached to the anchor line 18, are in the form of floats. As shown in FIG. 12, each float-conductor 132 includes a portion for clamping to the anchor line 18, a guide portion 134 for guiding and encircling a hose, and a center portion 136 which is buoyant and forms a float. This has the advantage that the vessel can sail away from the terminal location, leaving the anchor line only moderately lowered with the weight 28 on the sea floor. When the vessel returns, it can pick up a float 138 attached to an end 140 of the anchor line. The vessel can then pick up the upper end of the anchor line at 140 and raise it only a moderate distance to again provide a mooring terminal. A hose indicated at 142 and at 143 can remain attached to the conductors 132.

Figure 14:
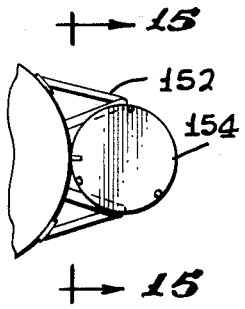
FIG. 14 is a view taken on the line 14—14 of FIG. 13.
Figure 13:
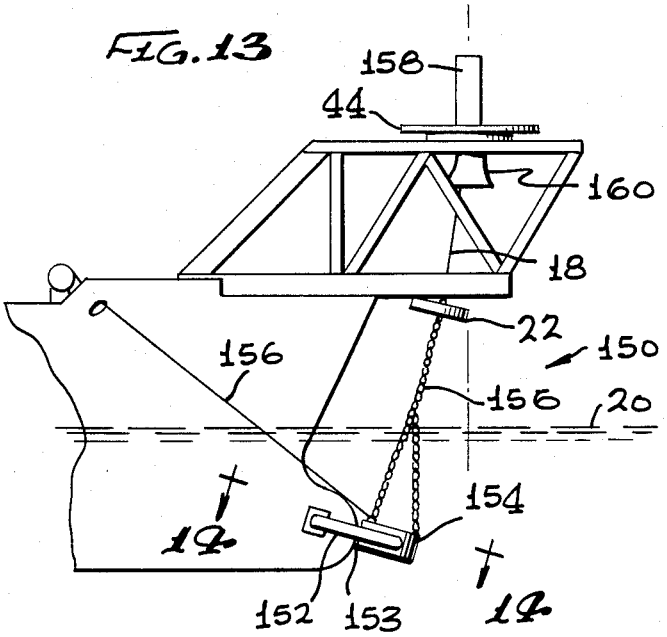
FIG. 13 is a side elevation view of a system constructed in accordance with another embodiment of the invention.
Figure 15:
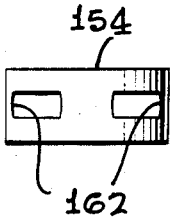
FIG. 15 is a view taken on the line 15—15 of FIG. 14, but without the holding structure.

FIGS. 13–15 illustrate a system which includes a weight-receiving structure 152 attached to an end of the vessel, preferably at an underwater location 153 which is the most forward underwater location of the vessel ('foward' is the direction away from the vessel middle). The weight 154 is held to the structure 152 against movement in every direction but forward, and is restrained from forward movement by a tying member 156. The tying member extends from the weight along an upward rearward incline, with the upper end of the tying member closer to the middle of the vessel than the weight. The weight hangs from the chain table 22 by a chain device 156. The chain table 22 is attached by the anchor line to a linear winch 128 that lies on the platform 44. Instead of hanging the winch from a universal joint, a trumpet-shaped fairlead 160 is provided to ensure at least a moderate radius of curvature of the anchor line 18 when it is under large tension. This arrangement avoids the cost of a universal swivel, although it results in the anchor line wearing out faster. To release the weight, the tying member 156 is detached from the vessel as by cutting it. The weight 154 then swings away from the weight-receiving structure, and it and the chain table can be lowered. It can be noted in FIG. 15 that the weight has a pair of recesses 162 that slideably couple it to the weight-receiving strucutre 152.

Figure 16:
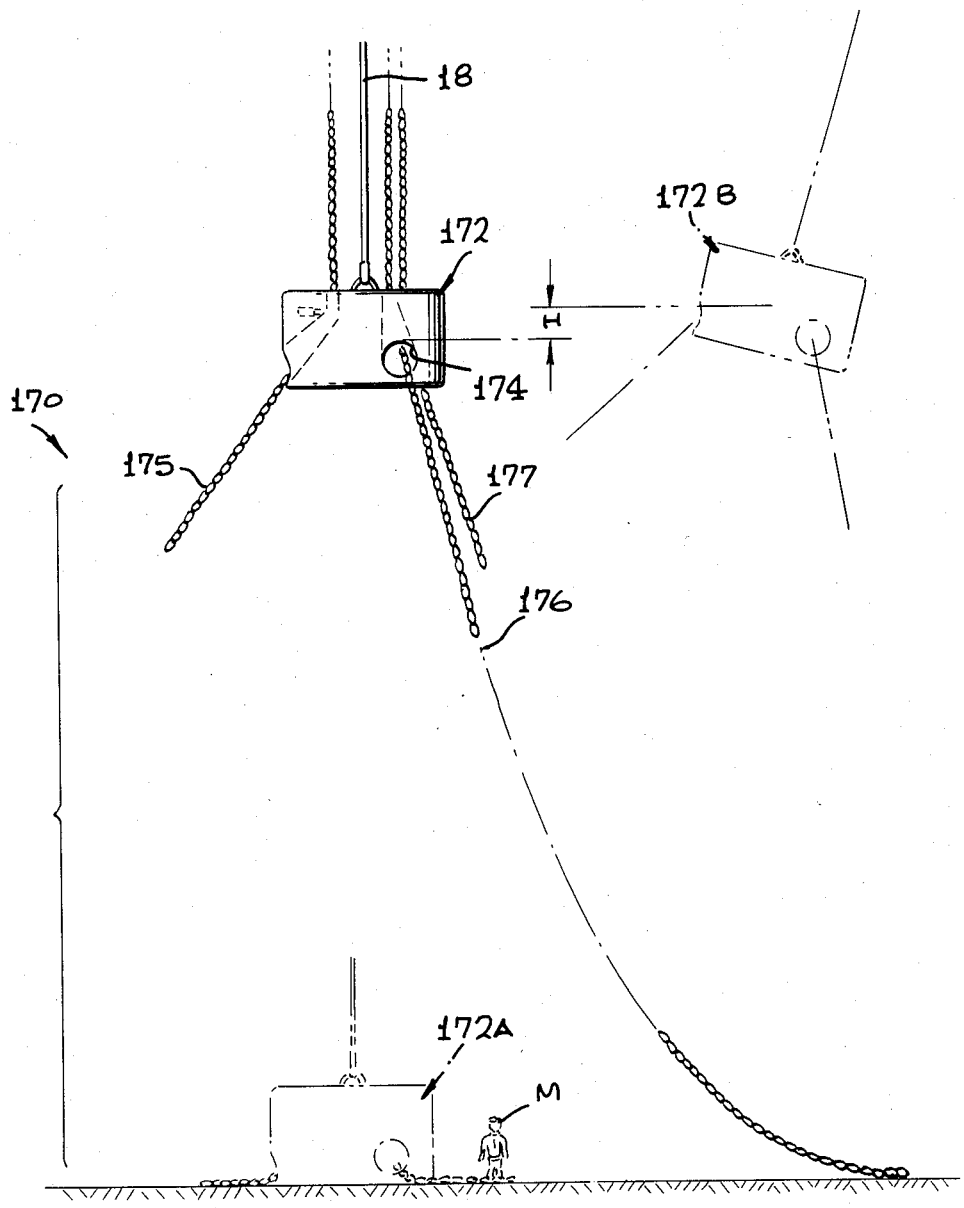
FIG. 16 is a partial elevation view of a mooring system constructed in accordance with another embodiment of the invention.

FIG. 16 illustrates another system 170 similar to that of FIG. 1, except that the chain table and weight are combined into a single chain table or energy storage unit 172. The chain table unit 172 can stably rest on the sea floor, as indicated at 172A, which occurs during installation and later if the vessel moves away. The unit has a mass and weight of more than 50 tons, to provide most of the weight which is raised (by height H) when the vessel drifts to shift the unit as to 172B. The raising of this weight causes it to store potential energy which is released by pulling the vessel back, which lowers the unit. At maximum expected drift forces the anchor line extends anywhere up to a maximum angle A (FIG. 1) of about 30 degrees from the vertical. The weight of the unit in air is more than 2,000 times the weight of each foot of anchor line in air, and is filled with dense material so it has a weight over 1,500 times the weight of each foot of the anchor line (steel) in air or water. Thus, even in very deep seas, of up to 2,000 feet depth, the unit will weight more than the anchor line.

The chain table unit 172 weighs more than the portions of all chains 175, 176, and 177 which lie above the sea floor in the quiescent condition of the system. In the previous example where the weight 28 of FIG. 1 had a weight of 360,000 pounds and the anchor line had a weight of about 65 pounds per foot, the weight had a mass of about 5,500 times each foot of anchor line. The weight 172 has a mass of somewhat more than 360,000 pounds (e.g., 400,000 pounds) when substituted in FIG. 1. Prior art single anchor line systems often used a chain table without a separate weight and constructed of perhaps one-quarter inch steel plate, and the chain table (and any fluid swivel) was as light in weight as possible, with the weight generally being only a few tons. In another type of prior art system, a buoy was included in the chain table. Applicant purposely uses a great weight without any buoy portion. In FIG. 16, the unit 172 is filled with material having a specific gravity of well over 3, such as iron (specific gravity of 7.9), except for a few holes 174 for passing chains. The size of the solid weight of about 9 feet height and 12 feet diameter can be compated to a man M of average height.

Thus, the invention provides a mooring system of the type which uses a single largely vertical anchor line whose lower end is anchored by chains to the sea floor, which enables a practical system to be used. A weight hanging under the chain table aids in installing it and enhances mooring of a drifting vessel. The upper end of the anchor line is held by a platform that can rotate with respect to a vessel. A sensor which senses turing of the platform controls a motor which rotates the platform to minimize twisting of the anchor line. A hose can be coupled to the transfer structure by extending the hose through conductors attached to the anchor line to stablize the hose position near the sea surface.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. In a mooring system wherein a vessel-mooring transfer structure near the sea surface is connected through a primarily vertical anchor line to a chain table that is nearer the sea floor than the sea surface, the chain table being anchored by a plurality of chain devices extending in different directions in catenary curves to the sea floor, the improvement wherein:

said transfer structure includes a rotatable portion and a nonrotatable platform, said rotatable portion being rotatable about a largely vertical axis about said platform, and including means on said platform which holds the upper portion of said anchor line; and including means for sensing actual rotation of said platform, and motor means coupled to said sensing means for rotating said platform to maintain the platform in a largely constant rotational orientation to minimize twist of said anchor line.

2. In a mooring system wherein a vessel-mooring transfer structure near the sea surface is connected through a primarily vertical anchor line extending along most of the sea height to a chain table that is nearer the sea floor than the sea surface, the chain table being anchored by a plurality of chain device extending in different directions in catenary curves to the sea floor, the improvement comprising:

a weight and a chain device hanging said weight directly under said chain table, said chain device being short enough that the weight always lies a distance spaced above the sea floor when the transfer structure moors a vessel.

3. A system for use with a vessel having bow and stern ends, to moor the vessel in a sea, comprising:

a weight-receiving structure mounted on one of said ends of said vessel and lying primarily underwater;

a weight which is releasable mountable on said weight-receiving structure, said structure preventing vertical movement of said weight but allowing largely horizontal movement away from said vessel end;

means on said vessel, and located closer to the middle of the length of the vessel than said weight-receiving structure, for holding a tying member which extends at least partially horizontally to the weight to apply a horizontal force preventing weight movement when the weight is mounted on said structure, said weight-receiving structure constructed to release said weight so it can move away from said vessel end and then fall, when not held thereto by said member.

4. In a mooring system wherein a vessel-mooring transfer structure near the sea surface is connected through a primarily vertical anchor line to a chain table that is nearer the sea floor than the sea surface, the chain table being anchored by a plurality of chain devices extending in different directions in catenary curves to the sea floor, the improvement comprising:

a winch on said transfer structure and coupled to said anchor line to lower said chain table;

a weight hanging a predetermined distance below said chain table, said anchor line being long enough so said winch can lower the chain table to a depth at which the weight rests on the sea floor, whereby to enable a determination of the height of the chain table above the sea floor.

5. In a mooring system wherein a vessel-mooring transfer structure near the sea surface is connected through a primarily vertical anchor line to a chain table that is nearer the sea floor than the sea surface, the chain table being anchored by a plurality of chain devices extending in different directions in catenary curves to the sea floor, the improvement wherein:

said transfer structure includes a rotatable portion, and a nonrotatable platform, said rotatable portion being rotatable about a largely vertical axis about said platform; and including a linear winch on said platform which holds the upper end of said anchor line and which can raise and lower said line; and a joint which is mounted on said platform, and which has a part which can pivot about at least one largely horizontal axis with respect to said platform, said winch mounted on said joint part, whereby to minimize bending of the anchor line when it is under tension.

6. In a mooring system wherein a vessel is moored by a transfer structure lying near the sea surface and connected through a primarily vertical anchor line to a chain table that is nearer the sea floor than the sea surface, the chain table being anchored by a plurality of chain devices extending in different directions in catenary curves to the sea floor, the improvement comprising:

said transfer structure includes a rotatable portion mounted on the bow of the vessel and a substantially nonrotatable platform, said rotatable portion being rotatable about a largely vertical axis about said platform with said largely vertical axis lying beyond said vessel bow, and including means on said platform which holds the upper portion of said anchor line;

said rotatable portion having a height of more than one meter and having upper and lower portions lying beyond said bow further than said vertical axis;

the bottom of said rotatable portion including beams on either side of said vertical axis extending to locations further from said bow than said vertical axis but free of connection to each other beyond said vertical axis, whereby to avoid interference with said anchor line when the vessel drifts.

7. A system for use with a vessel having opposite ends, to moor the vessel in a sea, comprising:

a weight-receiving structure mounted on an end of said vessel and lying primarily underwater;

a weight which is releasably mountable on said weight-receiving structure;

means on said vessel, and located closer to the middle of the length of the vessel than said weight-receiving structure, for holding a tying member which extends to the weight when the weight is mounted on said structure, said weight-receiving structure constructed to release said weight so it can fall, when not held thereto by said member;

a transfer structure having a rotatable part fixed to said vessel and extending beyond an end of the vessel and lying primarily above the sea surface, said transfer structure also having a platform above the sea surface which can rotate about a primarily vertical axis on said platform;

a winch on said platform, an anchor line extending from said winch, a chain table coupled to said anchor line opposite said winch, and a chain connected between said chain table and said weight, whereby the system can be set up by release of said weight without the need for other special equipment to handle the weight.

* * * * *